United States Patent [19]

Fox

[11] 4,041,856

[45] Aug. 16, 1977

[54] BALING MACHINE WITH IMPROVED PLATEN DRIVE AND GUIDE ASSEMBLY

[76] Inventor: Anthony Fox, 8306 Queen Ave. South, Minneapolis, Minn. 55431

[21] Appl. No.: 616,929

[22] Filed: Sept. 26, 1975

[51] Int. Cl.[2] ..... B30B 1/34; B30B 15/04

[52] U.S. Cl. ..... 100/214; 100/218; 100/245; 100/255; 100/269 R; 100/295

[58] Field of Search ..... 100/218, 255, 214, 295, 100/245, 269 R; 308/3 A

[56] References Cited

U.S. PATENT DOCUMENTS

| | | | |
|---|---|---|---|
| 2,430,973 | 11/1947 | Boissonnault | 100/269 R X |
| 3,280,727 | 10/1966 | Jonas | 100/255 X |
| 3,728,959 | 4/1973 | Fredrickson | 100/255 X |
| 3,862,596 | 1/1975 | Putkowski | 100/269 R X |
| 3,910,181 | 10/1975 | Andrews | 100/255 X |

*Primary Examiner*—Billy J. Wilhite
*Attorney, Agent, or Firm*—Orrin M. Haugen

[57] ABSTRACT

An improved baling machine for compacting loose waste material, such as paper, cardboard and the like. A pair of hydraulic cylinders, oriented crosswise to one another, when energized, cause a platen to move downward within a cabinet structure to compress the waste material contained therein. Because of the manner in which the hydraulic cylinders are pivotally mounted with respect to the cabinet frame and the movable platen, the force applied to the material to be baled increases as the stroke of the cylinder piston increases. Also, a unique arrangement of platen guide bars, cooperating with guide slots in the cabinet frame, prevent the platen from tipping and binding during the traversal of the platen.

1 Claim, 5 Drawing Figures

Fig. 1
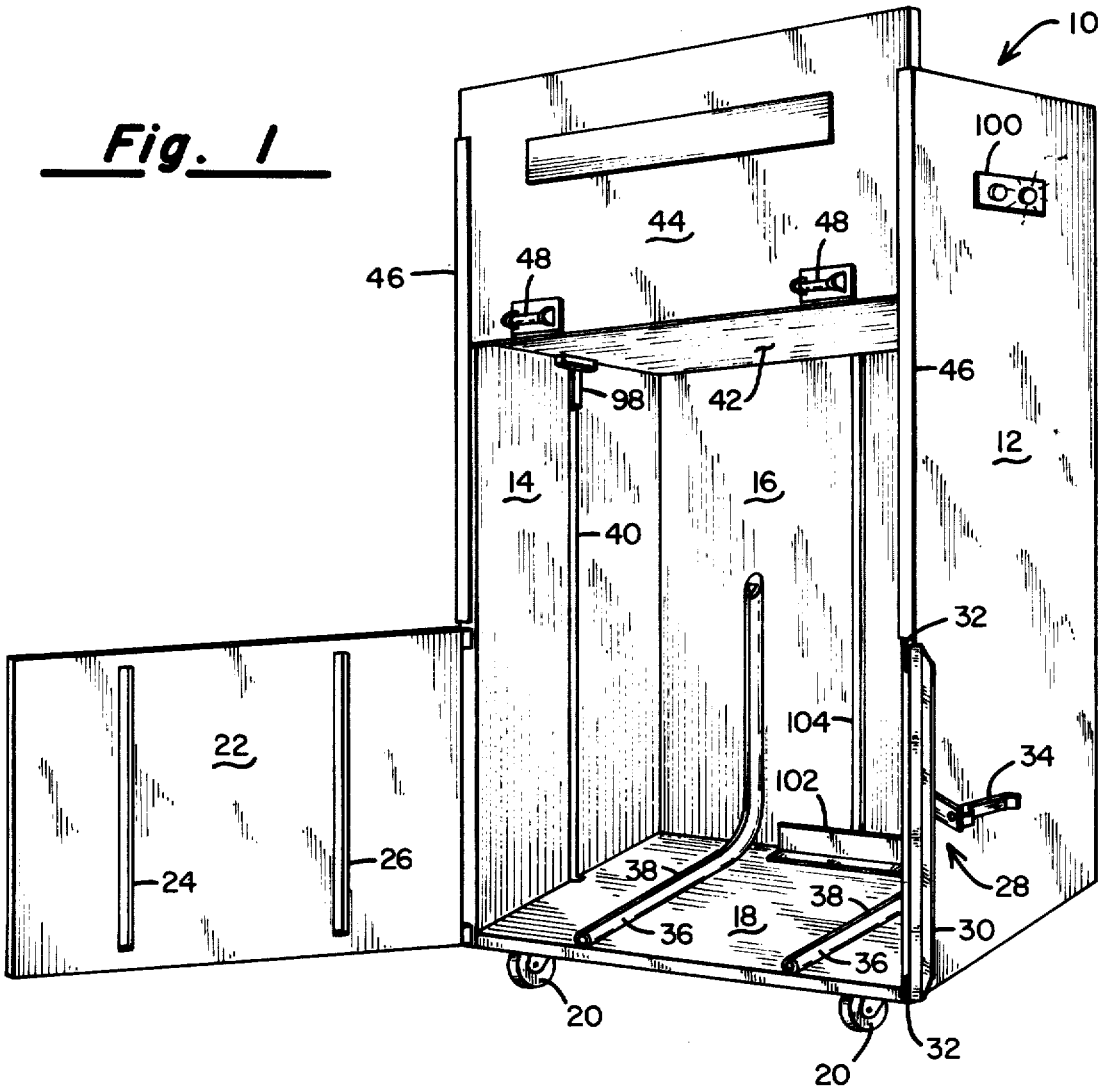
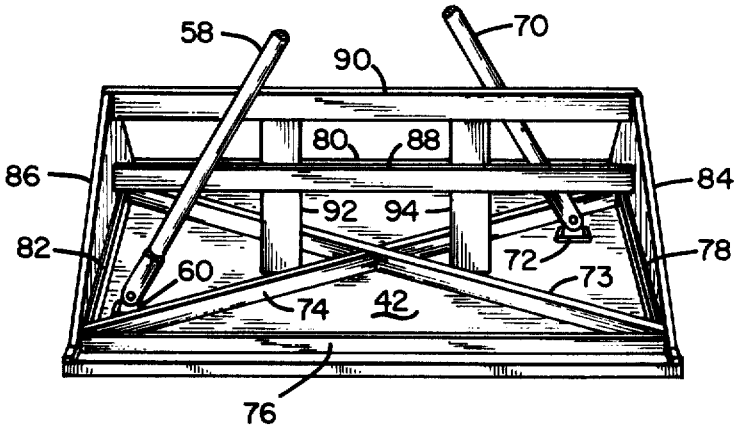
Fig. 3

BALING MACHINE WITH IMPROVED PLATEN DRIVE AND GUIDE ASSEMBLY

BACKGROUND OF THE INVENTION

This invention relates generally to a baling machine for compacting waste material and more specifically to an improved arrangement for driving and guiding the platen during the compaction stroke of the cycle.

Many forms of baling machines are known in the art. In general, they comprise a cabinet having access doors through which waste material may be loaded into the cabinet in advance of its being compressed and tied with baling wire. Prior art machines also include a mechanism, generally in the form of a movable platen, which, when actuated, is pressed downwardly on the material to be baled with relatively high force. In order to obtain a sufficiently long downward stroke of the platen, prior art machines have resorted to complex arrangements of mechanical linkages which are either motor driven or hydraulically actuated. These prior art arrangements have not been altogether successful in that they are wasteful of the energy (force) which may be obtainable from the source of motive power. Also, the prior art arrangements of which I am aware generally employ a set of wheels affixed to the sides of the platen for the purpose of stabilizing the platen during its downward travel. This arrangement suffers from a number of defects. First of all, the guide wheels do not sufficiently restrain the degrees of freedom of the platen so that during its descent and contact with an uneven mass of material to be compacted, the platen tends to tip or twist, thereby becoming bound with respect to the side walls of the cabinet. Continued application of the high forces can then damage the platen or the cabinet itself.

SUMMARY OF THE INVENTION

The present invention is believed to be an improvement over the prior art baling machines of the type described above. The baling machine comprises a cabinet having two side walls, a back wall and a front wall having a first access door through which material to be baled can be deposited into the cabinet and a second access door through which bales can be removed. Located centrally in each of the side walls and extending vertically are a pair of guide slots which are adapted to receive guide bars fixedly attached to the sides of a rectangular platen which, when in the retracted position, is disposed above the refuse to be compacted.

First and second hydraulically actuated cylinders are pivotally connected to both the movable platen and the structural frame members comprising the baler cabinet. More specifically, a first hydraulic cylinder has its piston rod pivotally connected to the platen at a point near the left side of the platen (when observed from the front of the cabinet) and its cylinder pivotally connected to the upper righthand side of the cabinet. The second hydraulic cylinder has its piston rod pivotally connected to the platen near its right-most edge and its cylinder pivotally secured to the upper lefthand side of the cabinet. Thus, the two cylinders are criss-crossed with respect to one another.

When the system is activated and hydraulic fluid is pumped into the cylinders, the piston rods are forced outwardly from the cylinders and the platen moves downward. As the platen descends, the cylinders rotate about their pivot points, assuming a more vertical orientation. As such, the downward force applied to the platen increases as the cylinder stroke increases. In fact, in one embodiment of the invention, the compaction force applied to the refuse is approximately 44,000 pounds.

As the platen moves downward, the guide bars affixed to the platen ride within the guide slots in the side walls of the cabinet and serve to constrain the travel of the platen to a horizontal plane. Thus, even when the refuse being baled is uneven, there is practically no tipping or twisting of the platen which might otherwise cause it to bind and result in damage to the equipment.

It is therefore a principal object of the present invention to provide an improved machine for baling refuse.

It is a further object of the present invention to provide an improved means for guiding the platen used in a baling machine during its travel.

It is yet a further object of the present invention to provide a novel mounting arrangement for the hydraulic actuators used to move the platen in a baling machine.

Other and further objects of the present invention will become apparent to those skilled in the art upon a study of the following specification, appended claims, and accompanying drawings.

BRIEF DESCRIPTION OF THE DRAWINGS

FIG. 1 is a pictorial view of the baling machine with its access door open to reveal the internal construction thereof;

FIG. 3 is a pictorial view of the platen assembly as observed from the top and front of the cabinet.

DESCRIPTION OF THE PREFERRED EMBODIMENT

Figure 2:
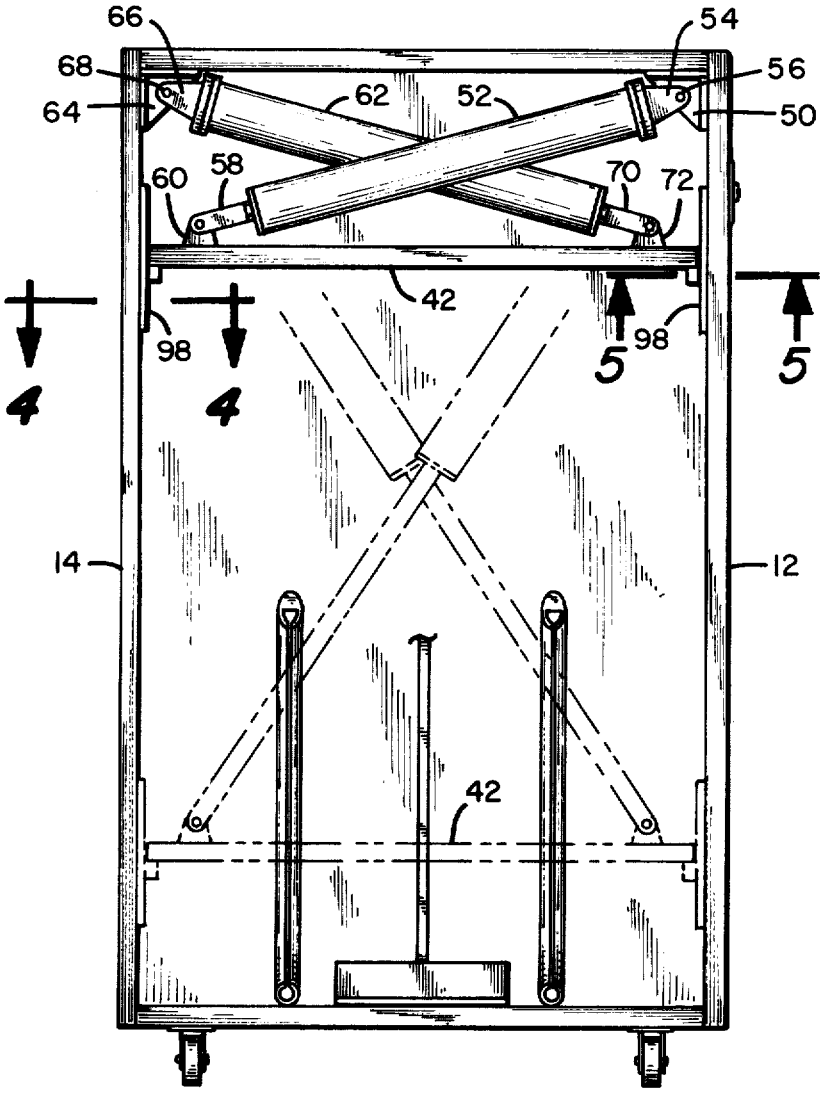
FIG. 2 is a frontal view of the baling machine which shows the orientation of the hydraulic actuators and platen in their raised and lowered positions.

Referring now to FIG. 1, there is illustrated a pictorial view of the baling machine of the present invention. The machine comprises a cabinet indicated generally by the numeral 10 having a right side wall 12, a left side wall 14, a rear wall 16 and a bottom wall 18. Each of these walls may be formed from a suitable material such as 10-gauge cold rolled sheet steel which is welded together to form a rectangular compartment. To provide portability, the cabinet may be mounted on lockable castors 20 having a diameter of 2½ inches.

A first access door 22 is mounted by means of hinges (not shown) to the left side wall 14 as illustrated. Formed in the access door 22 is a pair of vertical slots 24 and 26. When the door 22 is in its closed position, it may be secured by means of the latch assembly indicated generally by numeral 28. The latch assembly comprises an overlapping angle member 30 which is secured to the right side wall 12 by means of hinges 32. Affixed to the angle member 30 is a handle 34 which serves as a latch to lock the door 22 in a closed position between the edges of the cabinet wall and the angle member 30. The assembly 28 is designed to relieve pressure build-up in the compaction chamber before the door can be opened.

Contained within the cabinet and secured to the bottom plate or wall 18 and the rear wall 16 are a pair of tubes 36 which are bent at right angles and which have formed therein a continuous slot 38. The tubes 36 are positioned within the cabinet so as to be aligned with the vertical slots 24 and 26 in the access door 22 when the access door is closed.

Formed in the center of the side walls 12 and 14 are rectangular slots 40 which extend vertically from the bottom 18 of the cabinet to the top of the side walls. The slots 40 may be approximately 2 inches wide and 1 inch deep.

The movable platen is identified in FIG. 1 by numeral 42. Only the bottom surface of the platen can be seen in FIG. 1 because the remaining portion thereof is obscured by the vertically slidable access door 44 which is mounted in suitable guides 46 affixed to the front edges of the side walls 12 and 14. Handles 48 are provided for allowing an operator to conveniently raise and lower the access door 44 so that trash can be loaded into the compaction chamber.

Referring now to FIG. 2 which shows a front view of the cabinet with both access doors 22 and 44 removed, there is shown the platen 42 in both its raised and lowered positions, the lowered position being shown in phantom lines. Secured to the right side plate or wall 12 at its upper extremity is a triangular bracket 50 having a hole therein. A first hydraulically actuated cylinder 52 has a clevis 54 attached to it into which passes the angle bracket 50. A pin 56 passes through both the clevis and the triangular bracket, thereby allowing rotation of the cylinder member. The piston rod 58 of the hydraulic cylinder 52 is also pivotally connected to a bracket 60 which is welded to the upper surface of the platen 42 near its left-most edge. In a similar fashion, a second hydraulically actuated cylinder 62 is secured to a second triangular bracket 64 by means of a clevis 66 and a pin 68. The piston rod 70 of the hydraulic cylinder 62 is pivotally connected by a pin to a bracket 72 which is welded to the upper surface of the platen 42 near its right-most edge.

The cylinders 52 and 62 may have a 3½ inch bore and a 27-inch stroke and are adapted to be connected to a hydraulic pump (not shown) which is driven by a suitable motor, control over the fluid flow being obtained by suitable solenoid operated check valves (not shown).

As hydraulic fluid is introduced into the cylinders 52 and 62, their respective piston rods 58 and 70 are forced outwardly from their positions within the cylinders and a downward force is applied to the platen 42. Initially, the vertical component of the force exerted by the cylinders 52 and 62 is relatively small, but as the platen moves downward, the vertical force component increases, thereby exerting relatively large compression forces on the refuse material being compacted.

Also, the manner in which the hydraulic cylinders 52 and 62 are disposed between the cabinet and the movable platen, the displacement of the platen is substantially greater than that which can be obtained in known prior art arrangements where a cylinder is mounted in a vertical direction between the top of the cabinet and the platen. That is to say, in the preferred embodiment of the present invention, the platen displacement is equal to the stroke of the piston within the cylinder added to the radius of the arc struck as the cylinder members 52 and 62 rotate downwardly. This allows substantially more loose refuse material to be loaded into the baler prior to energization of the hydraulic cylinders.

Referring now to FIG. 3, there is shown a detail of the weldment and reinforcing structure located on the upper surface of the platen 42. As is illustrated, first and second steel reinforcing bars 73 and 74 are welded to the upper surface of the platen 42. For added strength and to prevent any warpage under extreme pressures, the perimeter of the platen 42 is also reinforced by members 76, 78, 80 and 82. Triangular end plates 84 and 86 are welded on the left and right sides of the platen and are maintained in a parallel relationship by means of cross-support members 88 and 90. Vertical posts 92 and 94 having a rectangular cross-section are also welded to the upper surface of the platen 42 and to the cross-members 88 and 90. This arrangement permits over 50,000 pounds of compaction force to be generated with no distortion of the platen.

FIG. 3 also illustrates the location of the pivot members 60 and 72 with respect to the left and righthand edges of the platen. It can be seen that these two pivots are displaced on either side of the center line of the width of the platen. Because of the manner in which these pivots are offset with respect to the center line, the cylinders 52 and 62 will not interfere with one another during operation.

Figure 4:
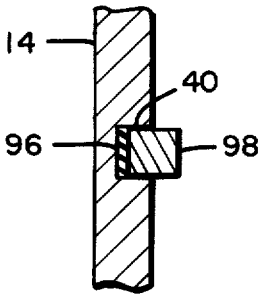
FIGS. 4 and 5 are cross-sectional views taken along the lines 4—4 and 5—5 respectively of FIG. 2.
Figure 5:
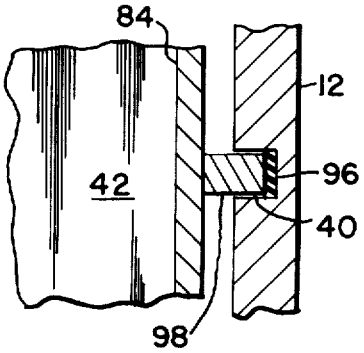

Referring again to FIGS. 1, 2 and 4, the features of the platen guide members will now be described. The cross-sectional view of FIG. 4 is taken along the section line 4—4 of FIG. 2 and shows the details of the guide slot 40 formed in the left side wall 14 of the cabinet. Disposed within the slot 40 and extending the full length thereof is a suitable bearing material 96 which may be, for example, brass or nylon. Welded or otherwise affixed to the left and right edges of the platen 42 and to the triangular end plates 84 and 86 are guide bars 98 formed from cold rolled steel bar stock. The width of the guide bars 98 is such that it fits within the guide slot 40 so as to allow relatively free vertical translation of the platen 42 with almost no rotation or horizontal translation thereof. By adopting this method of guiding the platen within the confines of the cabinet, it has been possible to eliminate the need for expensive hydraulic balancing apparatus which might otherwise be needed to insure proper control over the horizontal attitude of the platen as it descends.

OPERATION

In operation, the door 22 is closed and latched by the pressure releasing latch assembly 28 and the access door 44 is raised to allow refuse to be thrown into the cabinet. Periodically, the operator closes the access door 44 and depresses the start button 100. Provided various limit switches (not shown) are closed indicating that all doors are secure and it is safe to operate the equipment, the depression of the start button 100 will energize a motor control relay whose contacts are in series with the hydraulic pump motor across the alternating current lines. The starting of the hydraulic pump motor causes hydraulic fluid to be pumped from A reservoir into the hydraulic cylinders 52 and 62 causing the platen 42 to descend and apply high compaction forces on the refuse. The platen then automatically retracts to its upper position and the access door can again be raised so that additional refuse can be added. These cycles are repeated until pressure sensing switches (not shown) contained within the unit indicate that a full size bale is contained within the cabinet. The operator then inserts baling wire through the slots 24 and 26 in the access door 22 and the wire, when fed in, follows the tubes 38 going under the bale and up the rear side thereof. The wire is then brought out across the top of the bale and through the slots 24 and 26. Again, the operator depresses the start button causing the platen to move downward and apply compaction forces as the ends of the wires are knotted. Next, the operator opens the access door 22 and pushes a bale eject button (not shown) which activates still another hydraulic cylinder (not shown) causing the angle bar 102 to move upward in the slot 104 formed in the rear panel 16 of the cabinet. The raising of the angle bar 102 causes the bale resting thereon to be tipped forward, thus freeing it from the sides of the cabinet and allowing the operator to tip the bale forward, out of the cabinet and onto a cart. The slots 38 in the tubes 36 permit the baling wire to exit from the tubes.

Because the instant application is directed to the mechanical features of the baling machine, it is felt unnecessary to describe in detail the electrical and hydraulic control mechanisms employed. It should be understood, however, that the baler in which the present invention is utilized includes suitable safety switches and interlocks that prevent the apparatus from operating if any of the access doors are open. Also included are suitable signalling circuitry for advising an operator that the baler is full and needs to be unloaded.

Thus it can be seen that there is provided by this invention an improved arrangement of hydraulic actuators and platen guide structures within a baling machine which permits significant improvement over prior art designs. While there has been illustrated and explained a preferred embodiment of the invention, it is to be understood that various changes and modifications may be made thereto without departing from the spirit and scope of the invention as set forth in the following claims.

I claim:

1. In a baling machine of the type including a cabinet having top, bottom, right and left side walls and a rear wall and a rectangular platen having a central longitudinal axis being disposed for vertical motion within said cabinet, the improvement comprising:

a. first and second hydraulically actuatable cylinders disposed in said cabinet between said top and the upper surface of said platen, each cylinder having a ram arranged in extensible disposition therewithin;
   1. said first cylinder having a first end pivotally attached to said top and to said right side wall and the free end of its ram pivotally attached to said platen at a point proximate the left edge of said platen, and laterally offset from the central longitudinal axis thereof in a certain first transverse direction;
   2. said second cylinder having a first end pivotally attached to said top and to said left side wall and the free end of its ram pivotally attached to said platen at a point proximate the right edge of said platen, and laterally offset from the central longitudinal axis thereof in a direction opposed to said first transverse direction;

b. first and second vertical slots formed in said right and left side walls, with said slots being generally along said central longitudinal axis, respectively;

c. first and second guide bars affixed to the right and left edges of said rectangular platen and extending at least partially into said first and second vertical slots;

d. said rectangular platen comprising:
   1. a rectangular metal plate having a top and a bottom surface;
   2. first and second reinforcing bars affixed to the upper surface of said metal plate and extending diagonally thereacross;
   3. third, fourth, fifth and sixth reinforcing bars affixed to the upper surface of said plate along the perimeter thereof; and
   4. first and second triangular shaped metal side members attached to said upper surface of said metal plate at the left and right edges respectively, said first and second guide bars being attached to said triangular shaped metal side members and extending perpendicular to the top and bottom surfaces of said metal plate.

* * * * *